United States Patent [19]

Asanomi et al.

[11] Patent Number: 4,627,394

[45] Date of Patent: Dec. 9, 1986

[54] CYLINDER BLOCK FOR INTERNAL COMBUSTION ENGINE

[75] Inventors: Koji Asanomi; Ryoji Abe, both of Hiroshima, Japan

[73] Assignee: Mazda Motor Corporation, Japan

[21] Appl. No.: 712,142

[22] Filed: Mar. 15, 1985

[30] Foreign Application Priority Data

Mar. 21, 1984 [JP] Japan ..... 59-40236[U]

[51] Int. Cl.[4] ..... F02F 7/00

[52] U.S. Cl. ..... 123/195 R; 123/55 VE

[58] Field of Search ..... 123/195 R, 52.170, 55 V, 123/55 VE, 55 VS, 55 VP

[56] References Cited

U.S. PATENT DOCUMENTS

| | | | |
|---|---|---|---|
| 2,734,497 | 2/1956 | Chayne | 123/195 R |
| 2,740,393 | 4/1956 | Hoffman | 123/195 R |
| 2,817,327 | 12/1957 | Brenneke | 123/55 VE |
| 2,867,201 | 1/1959 | Dolza et al. | 123/195 R |
| 2,902,021 | 9/1959 | Leach | 123/195 R |
| 4,175,503 | 11/1979 | Ernest | 123/55 VE |
| 4,565,163 | 1/1986 | Ishimi et al. | 123/55 VS |

*Primary Examiner*—Craig R. Feinberg

*Attorney, Agent, or Firm*—Gerald J. Ferguson, Jr.; Michael P. Hoffman; James E. Bryan

[57] ABSTRACT

In a cylinder block for an internal combustion engine, a pair of opposed side walls thereof extending in the direction of the row of cylinders therein are respectively formed of a plurality of bight portions. The bight portions in each side wall differ in phase from those in the other side wall.

3 Claims, 4 Drawing Figures

CYLINDER BLOCK FOR INTERNAL COMBUSTION ENGINE

BACKGROUND OF THE INVENTION

1. Field of the Invention

This invention relates to a cylinder block for an internal combustion engine, and more particularly to a cylinder block for an internal combustion engine having an increased transverse rigidity.

2. Description of the Prior Art

As is disclosed in Japanese Unexamined Utility Model Publication No. 55(1980)-88047, there has been known a structure of a cylinder block for an internal combustion engine in which the side walls of the cylinder block are formed of a plurality of bight portions to suppress membrane vibration, thereby reducing vibration and noise of the engine.

However, the structure of the cylinder block disclosed in the Japanese Utility Model Publication is disadvantageous in that since nodes are defined at the junctions between adjacent bight portions which are located in the same positions in both the side walls, the rigidity of the overall cylinder block structure against lateral bending is weakened to create a primary vibrational-noise producing factor, though membrane vibration of the side walls can be effectively suppressed by forming the side walls of a plurality of bight portions. Especially, in a diesel engine, suppression of the vibrational noise is highly important.

SUMMARY OF THE INVENTION

In view of the foregoing observations and description, the primary object of the present invention is to provide an improved cylinder block structure for an internal combustion engine in which the membrane vibration is suppressed and at the same time the transverse rigidity of the cylinder block is enhanced, thereby reducing vibration and noise.

In accordance with the present invention, a pair of opposed side walls of a cylinder block extending in the direction of the row of cylinders are respectively formed of a plurality of bight portions, the bight portions in each side wall differing in phase from those in the other side wall.

In the cylinder block of the present invention, membrane vibration of the side walls is suppressed by forming each side wall of a plurality of bight portions, and since the bight portions in one side wall differ in phase from those in the other side wall so that the nodes at the junctions between adjacent bight portions in the side walls are not aligned with each other in the transverse direction of the cylinder block, the transverse rigidity of the cylinder block is enhanced, whereby vibration and noise can be reduced.

DESCRIPTION OF THE PREFERRED EMBODIMENT

Figure 1:
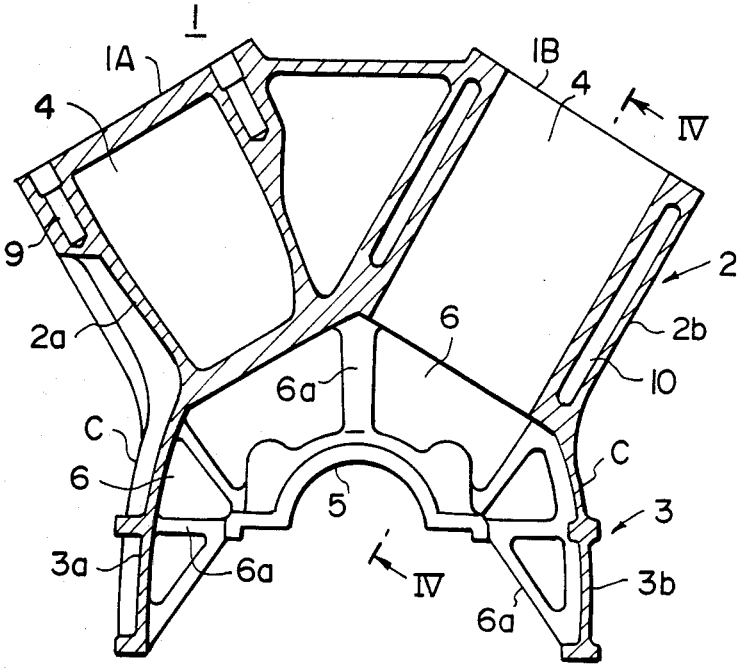
FIG. 1 is a cross-sectional view of a cylinder block for a V-type engine in accordance with an embodiment of the present invention.

In FIGS. 1 to 4, a cylinder block 1 in accordance with an embodiment of the present invention comprises a cylinder portion 2 and a skirt portion 3. The cylinder block 1 is for a V-type engine in this particular embodiment and is provided with a plurality of cylinders 4 in each of right and left cylinder banks 1A and 1B which are set at an angle to each other. The skirt portion 3 is provided at its center with a bearing portion 5 for supporting the crankshaft (not shown) for rotation, and the bottom of the cylinder portion 2 and the bearing portion 5 are connected with each other by partition wall portions 6 having ribs 6*a*.

Figure 2:
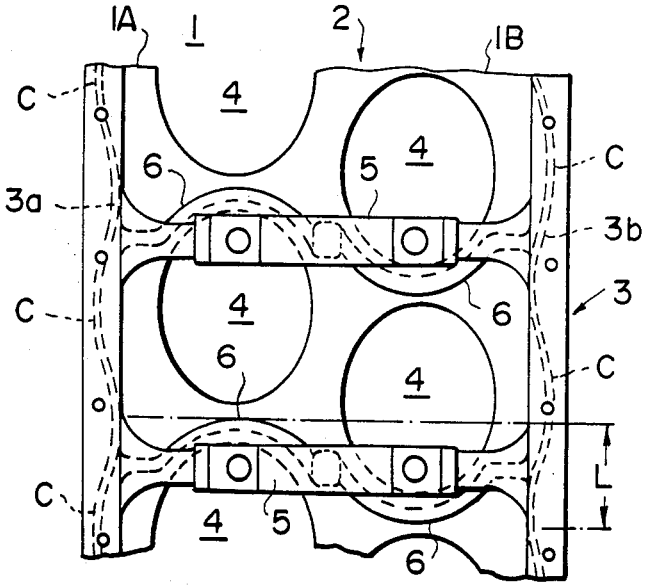
FIG. 2 is a fragmentary bottom view of the cylinder block of FIG. 1.
Figure 3:
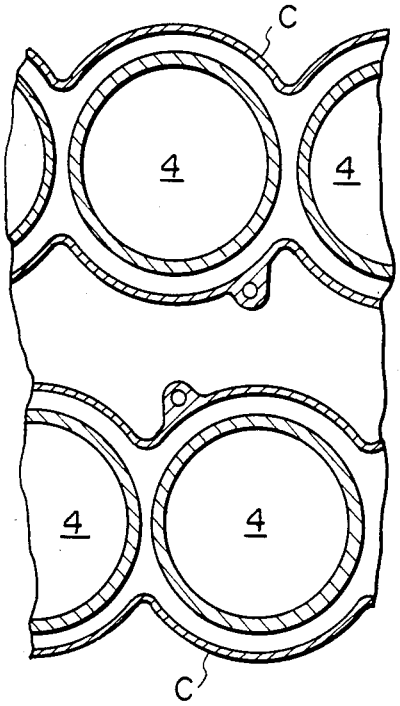
FIG. 3 is a fragmentary plan view of the cylinder block of FIG. 1.
Figure 4:
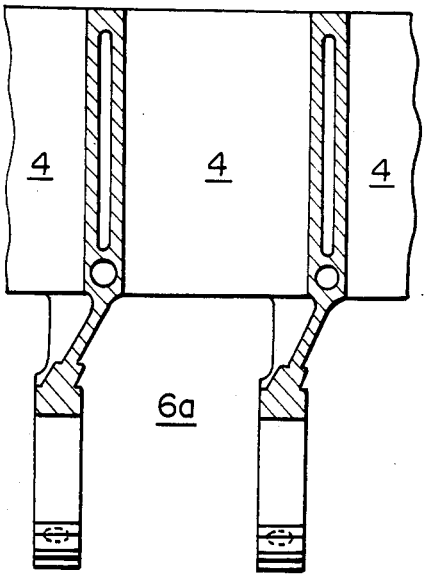
FIG. 4 is a cross-sectional view taken along line IV—IV in FIG. 1.

Right and left side walls 2*a* and 2*b* of the cylinder portion 2 and right and left side walls 3*a* and 3*b* of the skirt portion 3 extending in the direction of the rows of the cylinders 4 (the vertical direction as seen in FIG. 2) are formed of a plurality of bight portions C. The bight portions C in each side wall are equal to the cylinders 4 in number. The phase of the bight portions C in the right walls 2*a* and 3*a* is displaced from that of the bight portions C in the left side walls 2*b* and 3*b* by a distance L (FIG. 2).

That is, the right and left side walls 2*a* and 2*b* of the cylinder portions 2 of the cylinder block 1 are formed of a plurality of outwardly bulging bight portions C each of which is positioned corresponding to one cylinder 4. As is clearly shown in FIGS. 2 and 3, the row of the cylinders 4 in each cylinder bank is displaced from that in the other cylinder bank in the longitudinal direction of the cylinder block 1 and accordingly the phase of the bight portions C in each side wall is displaced from that in the other side wall. The bight portions C in the right and left side walls 3*a* and 3*b* of the skirt portion 3 connected to the lower side of the cylinder portion 2 are in the same phase respectively as those in the right and left side walls 2*a* and 2*b* of the cylinder portion 2, and accordingly the phase of the bight portions C in each side wall of the skirt portion 3 is displaced from that in the other side wall by the distance L.

Each of said partition wall portions 6 connects the bearing portion 5 extending in perpendicular to the row of the cylinders 4 and the bottom of the cylinder portion 2 and extends sinuously as viewed from below the cylinder block 1 to circumscribe a part of the lower end of one cylinder 4 in the right cylinder bank 1A and a part of the lower end of one cylinder 4 in the left cylinder bank 1B. This shape of the partition wall portions 6 increases the rigidity of the partition wall portions 6 and contributes to reduction of vibration and noise.

In FIGS. 1 to 4, reference numerals 9 and 10 respectively denote a threaded hole for a bolt for attaching a cylinder head to the cylinder head, and a water jacket.

Though in the above embodiment, the present invention is applied to a cylinder block for a V-type engine, the present invention can also be applied to in-line engines.

What is claimed is:

1. A cylinder block for a V-type engine comprising a cylinder portion and a skirt portion connected to a lower side of said cylinder portion, said cylinder portion comprising a pair of cylinder banks, each cylinder bank having a plurality of cylinders arranged in a row and a pair of opposed side walls extending in a direction along the rows of the cylinders with the cylinders each having a contour and being disposed between said side walls said skirt portion defining a crank chamber and having a pair of opposed side walls extending in a direction along the rows of the cylinders, and each integrally formed of a plurality of sinuous outwardly bulging bight portions, characterized in that the bight portions in one side wall of said skirt portion have a phase which is displaced from that in the other side wall of said skirt portion wherein the outwardly bulging light portions of each of the side wall of said skirt portion is formed in alignment corresponding to integrally formed outwardly bulging bight portions of the row of the cylinders of the respective cylinder banks which follow the contour of each of the cylinders.

2. A cylinder block as defined in claim 1 in which a bearing portion for rotatably supporting the crankshaft of the engine is provided in an internal space of the skirt portion to extend in perpendicular to the rows of the cylinders, and the bearing portion is connected to the cylinder block by partition wall portions extending sinuously as viewed from a bottom of the cylinder block to circumscribe a part of a lower end of the cylinders.

3. A cylinder block as defined in claim 1 in which at least an outer portion of the side wall of each cylinder bank of said cylinder portion has bight portions which follows the contour of each of the cylinders in each of the rows arranged in the cylinder bank.

* * * * *